US006749004B1

(12) United States Patent
Dal Pan

(10) Patent No.: US 6,749,004 B1
(45) Date of Patent: Jun. 15, 2004

(54) CONTAINER-FILLING DEVICE FOR LOST-FOAM CASTING SYSTEMS

(75) Inventor: Alfredo Dal Pan, Turin (IT)

(73) Assignee: Fata Aluminium division of Fata Group S.p.A., Turin (IT)

( * ) Notice: Subject to any disclaimer, the term of this patent is extended or adjusted under 35 U.S.C. 154(b) by 0 days.

(21) Appl. No.: 09/512,815

(22) Filed: Feb. 25, 2000

(30) Foreign Application Priority Data

Feb. 26, 1999 (EP) ..... 99830106

(51) Int. Cl.[7] ..... B22C 15/10
(52) U.S. Cl. ..... 164/203; 164/192
(58) Field of Search ..... 164/203, 206, 164/167, 192, 349, 34, 37, 39, 150.1, 151.2, 154.1, 154.2, 155.4, 322, 323, 169, 193, 194, 195, 196, 197

(56) References Cited

U.S. PATENT DOCUMENTS 3,868,986 A * 3/1975 Olsen ..... 164/7.1
4,454,906 A * 6/1984 Musschoot ..... 164/34
4,565,227 A * 1/1986 Shebuski ..... 141/1
4,593,739 A * 6/1986 VanRens et al. ..... 164/34
4,600,046 A * 7/1986 Bailey et al. ..... 164/34
4,685,504 A * 8/1987 Bond et al. ..... 164/203
4,736,787 A * 4/1988 McMellon ..... 164/154.1
4,768,567 A * 9/1988 Travillian ..... 141/67
4,784,206 A * 11/1988 Sauerman et al. ..... 164/18
4,844,142 A * 7/1989 Edge ..... 164/253
4,860,816 A * 8/1989 Bond ..... 164/154.1
4,947,923 A * 8/1990 Rikker ..... 164/5
4,971,135 A * 11/1990 Bailey et al. ..... 164/192

FOREIGN PATENT DOCUMENTS

GB 2 209 977 6/1989
GB 2209977 A * 6/1989 ..... B22C/15/10
JP 01 005640 1/1989
JP 1-005640 * 1/1989 ..... B22C/9/04
JP 10328783 A * 12/1998 ..... B22C/15/10

* cited by examiner

*Primary Examiner*—Kiley Stoner
*Assistant Examiner*—Kevin P. Kerns
(74) *Attorney, Agent, or Firm*—Sughrue Mion, PLLC

(57) ABSTRACT

The device, which can be used for filling containers in a lost-foam casting system, includes in a singe operational combination: supporting devices for containers with associated vibration devices to set the containers into vibration; a sand-feeding device, such as a hopper, for feeding dosed quantities of sand into the container; and a positioning device that make it possible to locate foam models into containers and sustaining them both while the sand is being fed into the containers and while the containers are being vibrated, thus avoiding the risks of malpositioning and/or breakage. Preferably, both the sand feeding hopper and model-positioning device on the same equipment capable of moving between a raised position in which the hopper may be loaded with the sand, while the foam models are being transferred by the positioning device, by a robot for example, and a lowered position, in which the models are inserted into the containers, after which the latter can be filled with sand.

10 Claims, 4 Drawing Sheets

CONTAINER-FILLING DEVICE FOR LOST-FOAM CASTING SYSTEMS

BACKGROUND OF THE INVENTION

The present invention relates to devices for filling containers in lost-foam casting systems.

The lost-foam casting technique represents an ever more widely employed foundry technique that is essentially based on the preparation of a model, generally made of polystyrene or some similar material, that exactly reproduces the characteristics of the piece to be cast. This model is inserted in a container (flask) filled with sand, which is then vibrated until the sand is distributed and compacted in such a manner as to adapt itself closely to and reproduce the exact shape of the model. Hot casting material (typically molten metal) is then poured into the space occupied by the model. The casting material dissolves the model and thus occupies the space that was previously occupied by the model in the surrounding sand. The final result is therefore the obtainment of a casting, i.e. a workpiece, that exactly reproduces the shape of the model.

SUMMARY OF THE INVENTION

The present invention comes to grips, first and foremost, with the problem of optimizing the operations that lead to the model being inserted or drowned in the sand prior to its compaction by vibration. In particular, the present invention avoids breakage or displacement of the model (typically realized in the form of a cluster of smaller individual models). Additionally, the invention also provides a filling device of the intelligent type, capable, in particular, of identifying the individual model and/or the container into which it has been inserted and thus making it possible, for example, to achieve selective specialization of the various processing operations, this to the point of treating each model/casting in accordance with a particular tailor-made process.

According to the present invention, this scope is attained by means of a container-filling device for lost-foam casting systems, including in a single operational combination:

- supporting means for containers with associated vibration means to set the containers into vibration;
- sand-feeding means capable of selectively feeding dosed quantities of sand into the containers; and
- positioning means that can selectively be associated with the containers to position foam models into the containers; the positioning means being capable of sustaining the models both while the sand is being fed into the containers by the feeding means and while the containers containing the said models are being vibrated by the vibration means.

BRIEF DESCRIPTION OF THE DRAWINGS

The invention will now be described, though purely by way of example and not to be considered limitative in any way, by reference to the attached drawings, where.

DETAILED DESCRIPTION OF THE INVENTION

Figure 1:
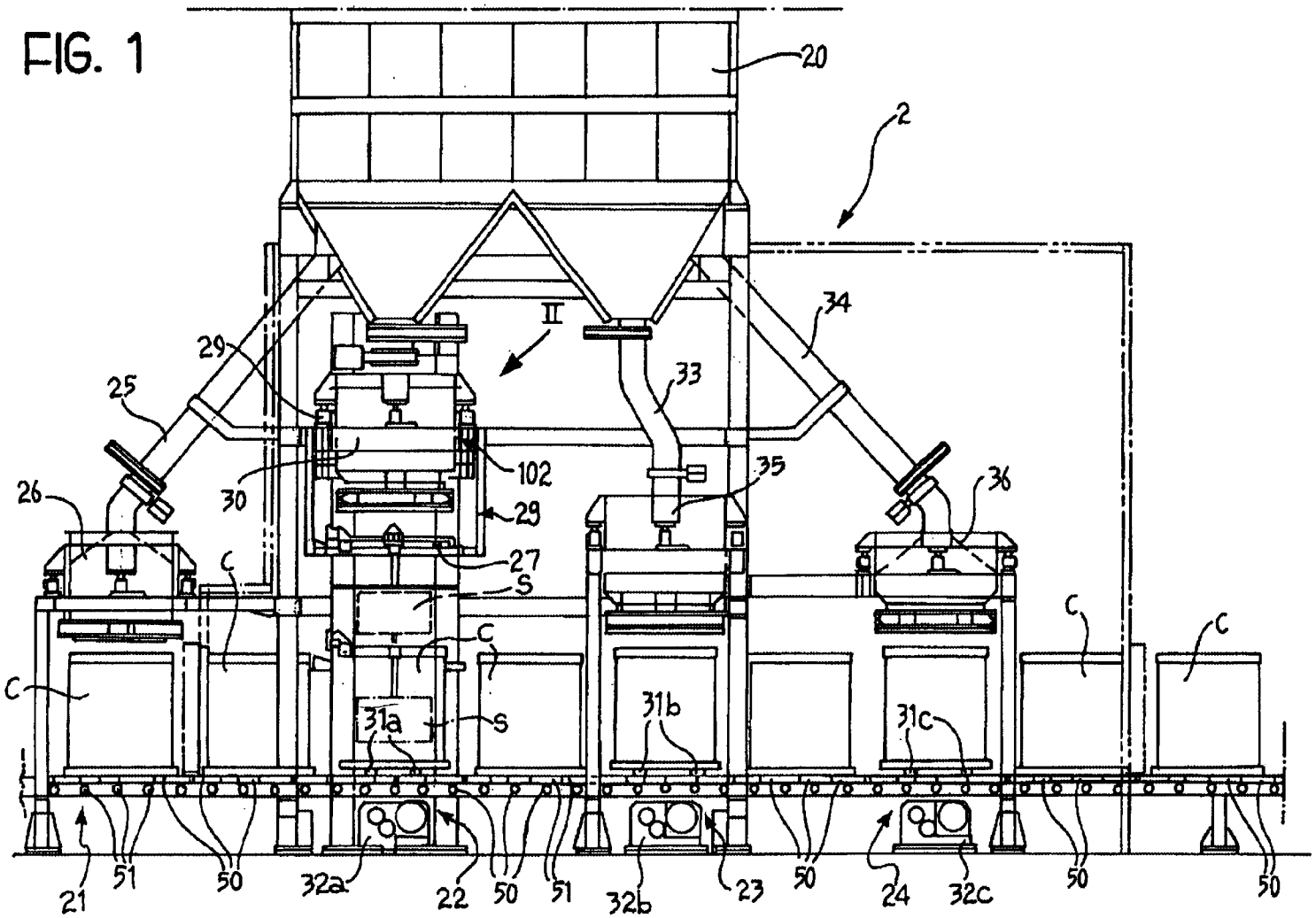
FIG. 1 shows a general view in side elevation of a container-filling station in a lost-foam casting system.

The general view of FIG. 1 represents a station 2 for filling the containers of a lost-foam casting plant or system. The plant in question could consist, for example, of the system described in greater detail in a European patent application filed on the same date by the same applicants.

At the station 2 the models S are inserted into the containers C in which the casting operations are to be performed, the said containers being subsequently filled with sand and subjected to vibration, so that the sand will eventually become compacted and be in close contact with the outer surface of the said models S.

The movement of the containers C is from left to right, with respect to the viewing direction of FIG. 1 so as to produce a step-by-step forward motion of the containers below a main silo 20 designed for feeding sand by means of free fall to four successive filling substations. The said filling substations are consecutively numbered from 21 to 24 in the direction in which the containers C move forward beneath the silo 20. For this purpose the containers C are usually placed on platform trolleys 50 that move forward (under the action of movement control means not shown on the drawing) on rotating bodies 51 that could be, for example, rollers or wheels.

In particular, the substation 21 can be defined as a prefilling station since a certain quantity of sand F (not shown in FIG. 1) originating from within the silo 20 is fed through a duct 25 and an associated hopper 26 into the bottom part of the container C that at any given moment happens to be in the substation 21.

The next substation, indicated by 22, has a somewhat more complex structure that will be described in greater detail later. At the substation 22 the polystyrene models S (usually in the form of model clusters, as already noted) are arranged inside the containers that have already had a certain quantity of sand filled into their bottom parts at the substation 21. The models S are usually taken from a feeder turntable (not shown in the figure) by means of a robot of which only the pick-up arms is shown by means of a dashed line in FIG. 2. The design and operating details of the robot in question (which could be of any known type, an anthropomorphic robot being a case in point) are not in themselves relevant for a proper understanding of the invention and will not therefore be described in any detail. Here it will be sufficient to recall the fact that the model S normally consists of a model cluster provided with a grip formation T by means of which it can be picked up by the arm R of the robot to be sustained centrally, i.e. in a position that substantially coincides with the barycentre, by a positioning element indicated by the reference number 27 and subsequently described in greater detail.

At the substation 22 the container C receives, this time from the hopper 30, a further quantity of sand intended to cover the model S for a substantial part of its height.

At the said substation 22 the container C is also lifted slightly in a vertical direction to detach it from the conveyor structure 50, while the lifting organs 31*a* (see FIG. 3) that perform the said lifting action are caused to vibrate by means of a vibration device 32*a*. In this way the sand inside the container C is subjected to the necessary vibration and compaction action. Both the pick-up (gripping) organs 31*a* and the vibration device 32*a* are well known in the art and need not therefore be described in further detail.

The action of filling the container C with sand is completed at the subsequent substations indicated by 23 and 24. As far as complexity is concerned, these two substations may be said to be intermediate between the complexity of substation 21 and that of substation 22. In fact, the substations 23 and 24 include respective ducts 33 and 34 for feeding sand from the silo 20 into the hoppers 35 and 36. In this case, of course, there is no longer present the complex of parts and elements needed for arranging the models S inside the containers C. But what does have to be present at this stage are the lifting organs 31*b* and 31*c* and the vibration devices 32*b* and 32*c*, which are substantially similar to the devices 31*a* and 32*a* that have already been described in connection with substation 22.

The choice of carrying out the filling and the vibration of the containers C in successive phases is in keeping with the need for gradual immersion of the model S in the sand, thereby assuring that the sand around it will become fully compacted. This choice is also imposed by the general needs bound up with the timing of the forward movement of the containers C on the conveyor system and assuring the desired productivity levels.

Figure 3:
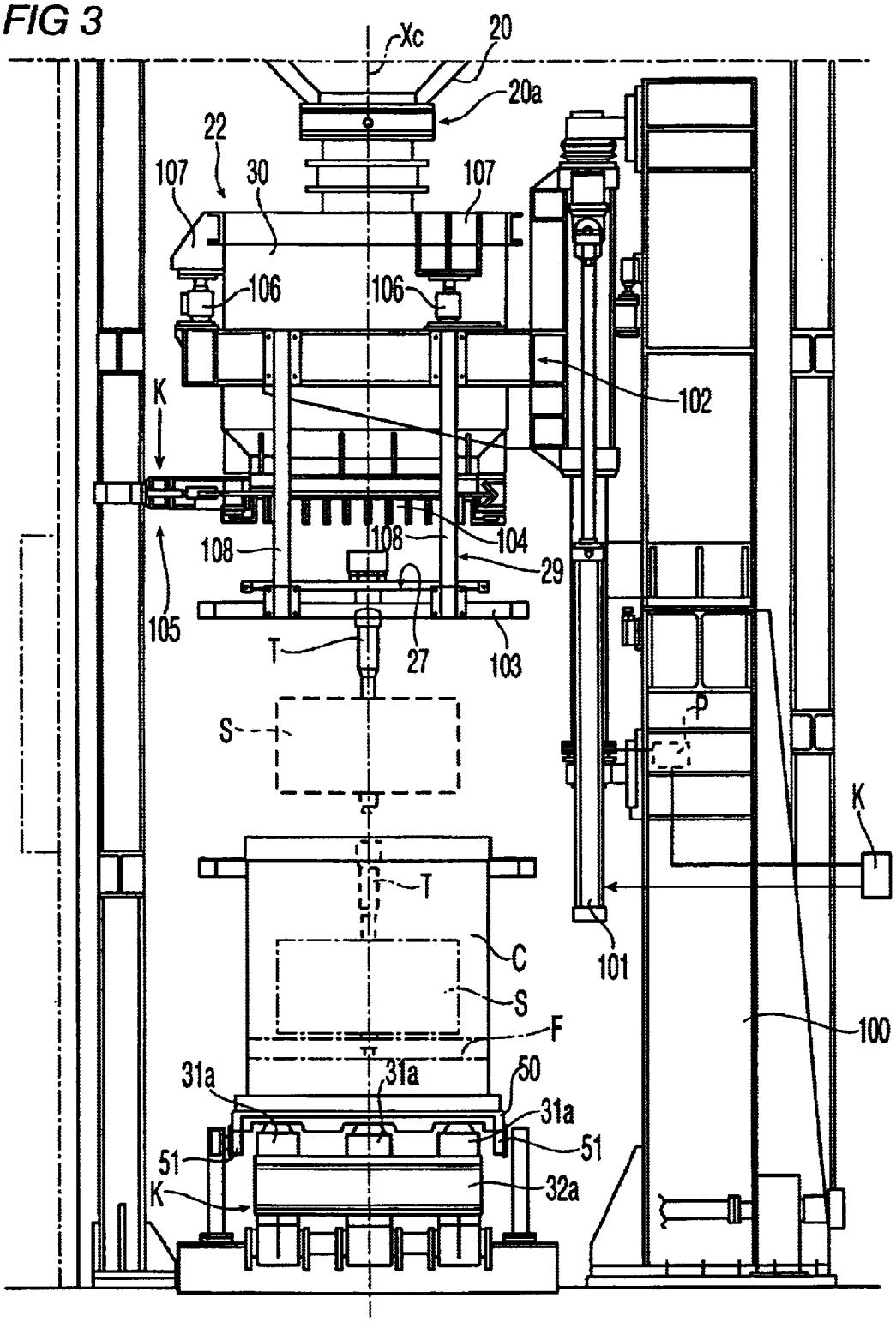
FIG. 3 shows another view in side elevation of the device shown in FIG. 2, but this time seen in a direction that is substantially orthogonal with respect to the viewing direction of FIG. 2.

FIG. 3 shows in greater detail the structure of the device that constitutes the substation 22. Referring to the side elevation shown in this figure, an upright 100 is in a position that can be described as being by the side of the line along which the trolleys 50 bearing the containers C are moving forward.

Mounted on the said upright 100 in such a way as to enable it to move up and down under the action of an appropriate fluid jack 101 there is a mobile item of equipment 102 having the general structure of a projecting bracket. This bracket-like structure 102 sustains the hopper 30 below the bottom outlet opening 20*a* of the silo 20 and also extends downwards in the form of a cage structure 29 which carries a frame 103 in a position below the hopper 30. In its turn, the said frame 103 sustains the previously mentioned positioning element 27 in a generically central position.

The complex of parts just described, usually realized in the form of structural steelwork, is therefore capable of moving vertically along an axis $X_c$ along which the following elements are arranged:

- the bottom outlet opening 20*a* of the silo 20,
- the hopper 30 with its discharge opening 104, complete with an appropriate opening and closing system 105 of a known type,
- the frame 103 with the positioning element 27 that, in its turn, sustains the model S in a central position, and
- the container C that at that particular moment occupies the substation 22.

The bracket-like structure 102 is in the form of a square metal frame capable of carrying the hopper 30 through the intermediary of appropriate load cells 106 (which may be three in number, for example) on which rest the correspondingly positioned bracket structures 107 projecting radially from the upper edge of the hopper 30. The load cells 106 therefore provide signals that indicate the quantity of sand present in the hopper 30 and, consequently, the quantity of sand that will eventually be transferred into the container C below the hopper.

The frame 103 is suspended from the structure 102 by means of the legs 108, which do not in any way encumber the space within the frame 103 intended to be occupied by the positioning element 27.

The said element includes a central hub 109 that carries a clamp 110 with a control unit 116. The hub 109 is sustained by a series of spokes 111 that connect it to an inner frame on which there is mounted at least one other clamp 112 with its own control unit 113. Preferably, however, there will be three such clamps, distributed in a substantially uniform manner along the circumference of the inner frame.

The frame 103 also carries one or more centering formations 114.

The said centering formations preferably include a fork element 114*a*, which, when the element 27 comes to be located (as will be described in greater detail later) at the level of the upper rim of the container C, will engage with an appropriate counterpart projecting from that rim and will thus avoid undesired relative rotations. Usually there will also be present a pin 114*b*, as well as a corresponding cavity 115 carried in a peripheral position by the inner frame of the frame 103.

The operating units 116 and 113 of the clamps 110 and 112 are in their turn controlled, just like the unit that controls the aperture of the outlet opening. 20*a* of the silo 20, by the unit 105. The unit 105 also controls the feeding of the sand from the bottom opening 104 of the hopper 30, the load cells 106 and the control unit of the jack 101, by a processor-type control unit K. The control unit K may consist, for example, of a so-called PLC (acronym of Programmable Logic Controller) or some equivalent processing unit that controls (in accordance with criteria that are in themselves known and/or will be rendered obvious by the present description) the operation of these organs in a manner that is fully coordinated with the operation of the other parts of the plant, especially the robot R and the trolleys 50.

The operating unit 113 is preferably configured in such a manner that, with the system at rest, the return elements, springs for example, will keep the clamps 112 in their fully open position.

Figure 2:
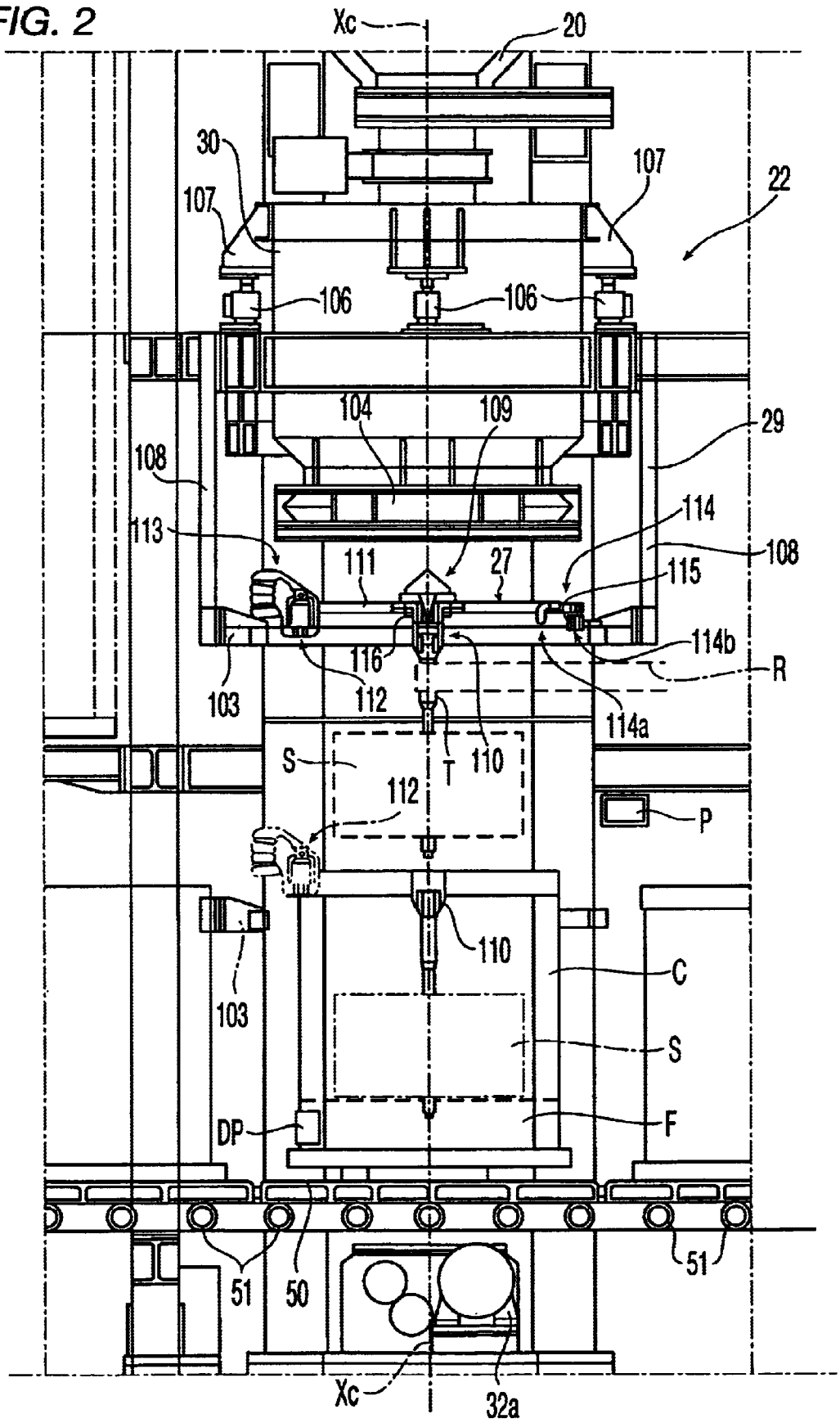
FIG. 2 shows a larger-scale view of the part of FIG. 1 indicated by the arrow II.

As can be more readily appreciated from the view reproduced in FIG. 2, the positioning element 27 is not fixed to the frame 103, but rather rests freely and, be it noted, in an exactly centred position on the said frame, and can therefore become disengaged from the frame 103 by performing an upward movement relative to it.

The operating cycle of the device constituting the substation 22 can be summarily described in the following terms.

The device gets ready to receive a container C (already containing the quantity of sand received at the substation 21 on the upstream side) while the complex of parts sustained by the bracket-like structure 102 is in the position shown by means of full lines in both FIG. 2 and FIG. 3. In other words, when the substation is ready to receive a new container, the fluid jack 101 keeps the entire structure at the upper end of its travel.

Let us suppose that when the container C arrives, as also in the phase that immediately precedes or follows its arrival, the robot R has already picked up a model S and inserted the grip formation T with which it is provided into the clamp 110. The clamp is first maintained in its open position, which enables it to receive the said grip formation T, and is then closed around it, so that it will carry the model S. After releasing the model S it has just loaded into the substation 22, the robot arm R returns towards the structure from which the models are picked up (which is typically of the turntable type and is not illustrated) in search of a new model S.

In the meantime, the outlet aperture 20*a* of the silo 20 has been opened, so that there has dropped into the hopper 30 a quantity of sand corresponding to the quantity it is subsequently desired to discharge into the container C.

At this point the jack 101 is operated in such a way as to cause the entire supporting structure 102 to become gradually lowered towards the container C. This operation ensures that the model S will be lowered into the container C.

In the course of this operation the model is lowered from the position shown in FIGS. 2 and 3 by means of full broken lines to the position indicated by means of the chain-dotted lines in the same figures.

In the lowered position previously referred to, the model S usually comes to rest on top of the sand F already contained in the container C as a result of the pre-filling operation previously carried out at the substation 21. In any case, the said downward movement causes the clamps 112 to engage the upper rim of the container C. Activation of the control unit 113 (likewise controlled by the PLC K) ensures that the clamps 112, originally open, will now tighten and grip the rim of the container C. The series of spokes 111, and therefore also the hub 109 they carry in a central position, will thus come to constitute what is de facto a single piece with the container C. This applies also as regards the clamps 110 carried by the hub 109 and, consequently, the model S.

In the said lowered position, therefore, the operating unit 105 controlling the bottom outlet of the hopper 30 can be activated to open the said outlet, so that the quantity of sand contained in it will now be discharged into the container C and thereby cover the model S.

It will readily be appreciated that the said model is kept firmly in a fixed position with respect to the container C by means of the clamp 110 carried by the hub 109, which in its turn is linked by means of the spokes 111 to the clamps 112 that grip the rim of the container C.

The descending sand will not therefore be able to cause any undesired displacements of the model S while the container is being filled. There is no undescribed displacement even when the sand comes down in a rush of considerable intensity and/or when the model has surfaces orientated in such a manner as to exert a certain deflection action on the falling sand F so that the model, by reaction, becomes subject to a certain fluid dynamic thrust.

Examination of FIG. 2 also makes it clear that, since the clamps 112 grip the rim of the container C, the positioning element 27, taken as a whole, will no longer be able to follow the downward movement of the frame 103. The travel of the jack 101 is in fact regulated (in a manner coordinated with all the other dimensional magnitudes in play) in such a manner as to ensure that when the frame 103 reaches its lowermost position, it will be wholly disengaged from the positioning element 27 and, consequently, also from the model S.

In these conditions, the container C, complete with the model S and the further quantity of sand it received at the substation 22, can be subjected to the vibration operation, which is performed, in a known manner, with the help of the generator 32*a* while the lifting organs 31*a* keep the container C lifted off the trolley 50 used to transport it.

Vibratory motion is applied to the body of the container while the model S is kept in a fixed position with respect to the container C by means of the various parts numbered 109 to 112. This ensures that the said vibratory motion, no matter how great its amplitude or intensity, will not be able either to displace the model S from its correct position or to cause a breakage of its gripping formation T, which in most cases will eventually define the channel through which the casting material will be poured into the container C.

On completion of the vibration operation, the lifting organs 31*a* will again lower the container C onto its trolley 50. At this point the jack 101 can be operated in the direction that will cause the structure 102 to become raised, while both the clamps 110 and the clamps 112 are opened, so that the positioning element 27 becomes disengaged from both the rim of the container C and from the grip formation T of the model S, which has to remain within the container C.

The frame 103 will therefore begin to rise and engage with the positioning element 27.

The presence of the centering formations 114 (114*a*, 114*b*) and their respective complementary formations ensures that the positioning element 27 will again become engaged with the frame 103 in an accurately defined position, so that the starting conditions indicated by means of the full lines in FIGS. 2 and 3 can eventually become exactly reconstituted.

Figure 4:
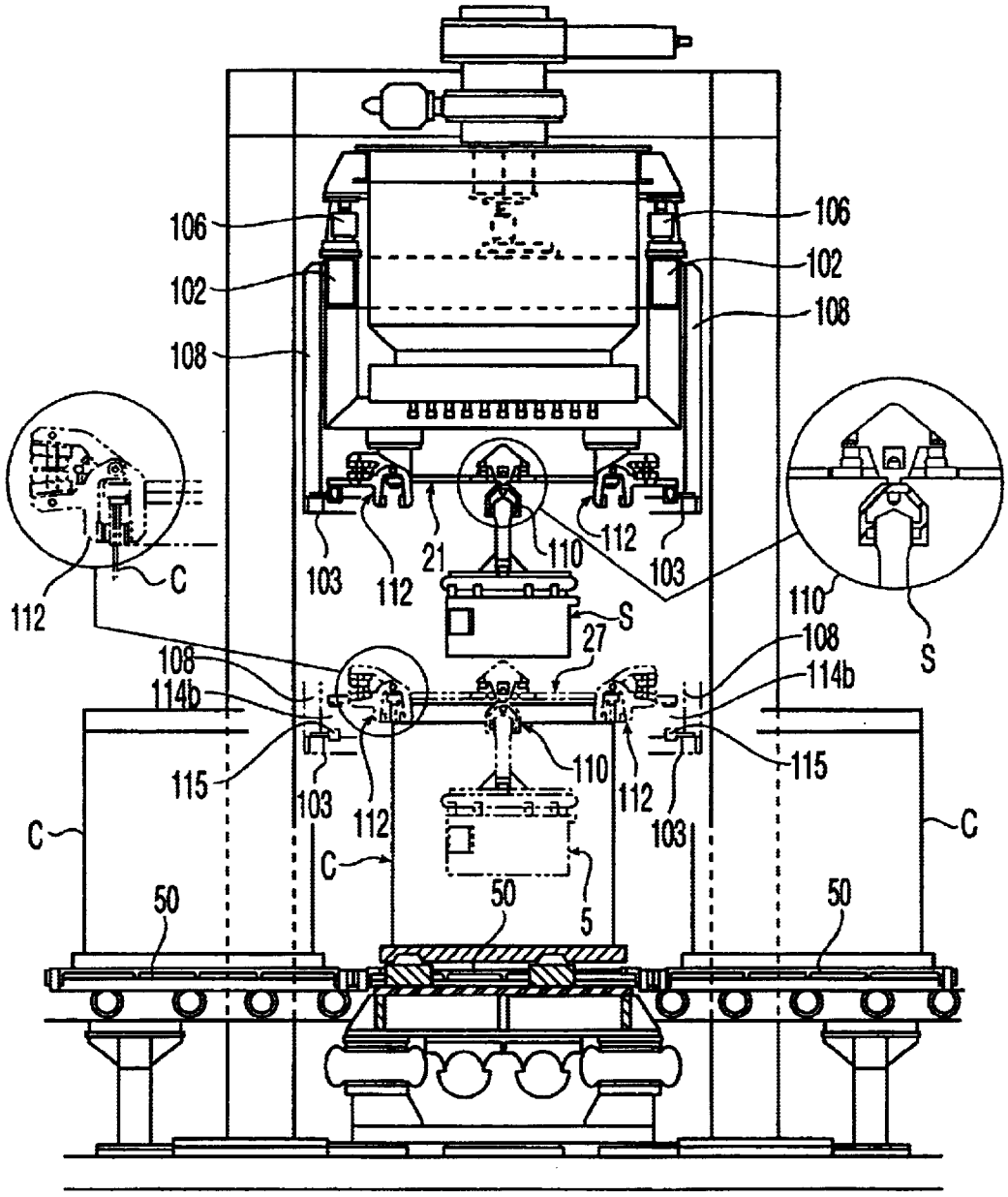
FIG. 4 is a simplified explanatory view based on FIG. 2.

FIG. 4 is view similar to FIGS. 2 and 3 in as much as three containers C are shown with the middle one being located above a vibration device 32*a* to set the middle container C in motion. Supporting means are provided for each container C which is placed on and supported by a trolley 50. Sand feeding means are comprised of the hopper 30 for feeding sand into the container C. Positioning means 27 as well as the model S which is clamped to the positioning means 27 by means of the clamp 110 is shown in the raised position as well as in the lowered position in which the model is located within the container C. Container gripping means 112 are comprised of three peripheral clamps 112 two of which are shown in FIG. 4. The one shown on the left is also shown to an enlarged scale is for flipping the container C. The gripping means 112 are in the open position when the positioning means is in the raised condition as shown in FIG. 4. Vertical movement of the positioning means.

Vertical movement of the positioning means 27 is controlled by the fluid jack 101 shown in FIG. 3 which moves a bracket like structure 102 up and down. Suspended to the vertically moveable bracket-like structure 102 by legs 108 is a frame 103 having cavities 115. The positioning means 27 includes vertical pins 114*b* of the centering formations 114 which engage corresponding cavities 115 which are carried by the frame 103 whereby the positioning means 27 rests on the frame 103 in the raised or resting position as shown in FIG. 4. Upon lowering the frame 103 the positioning means 27 will engage the upper edge of the container C and the positioning means 27 will become disengaged from the frame 103. In this position the clamps 112 will automatically clamp onto the container C. Since the positioning means 27 is now clamped to the model S by means of the clamp 110 and simultaneously is clamped to the container by means of the clamps 112, the model S and the container C will be joined as single piece for vibration as a unit.

When the structure 102 and the various elements it carries have eventually returned to their raised position, the container transport line can again be set in motion, so that the container C that has just been processed will be moved forward to substation 23 of FIG. 1, while a new container will be moved from substation 21 to the device that constitutes substation 22.

While this is happening, the robot R has the time it needs to insert a new model S into the clamp of the positioning element 27 and the bottom outlet 20*a* of the silo 20 can be opened again to reconstitute the sand supply needed in the hopper 30 for the next filling.

In addition to the previously described advantages in connection with the operations of filling the sand into the container C and vibrating it, the solution according to the invention therefore has the further advantage of permitting the operations of loading the models S and filling the hopper 30 to be carried out while the containers are being moved, thus avoiding possible idle times.

As already mentioned in the introductory part of the present description, the substation 22 that has just been described in detail usually forms part of a plant or system that, in addition to the said substation 22 and the container transport system 50, includes also other stations and sub-stations for carrying out the following technological operations in due succession:

sand filling and vibration (other substations 21, 23 and 24 as already described)

casting (one station)

extraction of castings and sand (one station).

The last two of these stations are of a known type and have known characteristics and have not therefore been illustrated on the attached drawings.

As already mentioned, at the entry side of the system the clusters constituting the models S are loaded with the help of a buffer turntable that presents them to the robot R, which then picks them up from the turntable and automatically feeds them into the sub-station 22.

Given the different types of pieces (and therefore models and castings) that may have to be made, the following may vary:

sand filling (speed at which the containers C are filled, as well as the level to which the containers are filled at the various sub-stations 21–24);

vibration (vibration frequency and/or duration);

casting (quantity of metal to be cast, casting modalities);

extraction of the castings (angle of inclination of the container when it is tipped to permit the castings to be picked up, usually by means of an anthropomorphic robot).

These variables and the possible changes associated with them can therefore be configured as a typical recipe for each casting.

The solution according to the invention is such that these functions can be completely automated. To this end, matters can be arranged in such way that the robot R, immediately after picking up a model S from the turntable, presents it in front of an identification station consisting, for example, of a television camera P and an appropriate model recognition module of a known type and possibly resident in the control unit K. The identification station recognizes the model S (among a set of possible models) and thereupon informs the system of the particular recipe needed for: this model. This can be done by means of an appropriate type identification signal generated, for example, in the control unit K.

Once it has been inserted in the container C at the sand-filling station, the model S is—as it were—paired with the container (which is provided with a plate DP, which could be—for example—of the magnetic or optical reading type, on which the casting data, recipe included, can be memorized). Prior to entry into each technological station, an electronic reader informs the station in question of the contents of the container, thus enabling it to fall into line with the parameters of a particular recipe.

Naturally, the realization details and the implementation forms can be widely varied with respect to what has hereby been described and illustrated without in any way altering the principle of the present invention or going beyond its scope as defined by the claims set out below.

What is claimed is:

1. A container-filling device for lost-foam casting systems, including in a single operational combination:

supporting means for containers with associated vibration means to set said containers into vibration;

sand-feeding means for feeding dosed quantities of sand into said containers; and positioning means associated with said containers to position foam models into said containers and support said models both while the sand is being fed into the containers by said feeding means and while the containers containing said models are being vibrated by said vibration means;

wherein said positioning means include first model gripping means connected to said positioning means for gripping said models, and second container gripping means connected to said positioning means for gripping said containers, so that, with said first and second gripping means gripping, respectively, the models and the container, the models will be kept firmly in a fixed position with respect to the container during the vibrational motion generated by said vibration means.

2. A device in accordance with claim 1, including control means to bring said first and second gripping means into their gripping positions while said vibration means are operating.

3. A device in accordance with claim 1, wherein said first and second gripping means comprise a clamp structure.

4. A device in accordance with claim 1, wherein said second gripping means have associated with them means for bringing them back into their open position.

5. A device in accordance with claim 1, wherein said positioning means have associated with them a respective moving structure from which said positioning means can be disengaged.

6. A device in accordance with claim 5, also including mobile equipment movable between a lowered portion and a raised portion with respect to said containers and wherein said sand-feeding means and said positioning means are carried by said mobile equipment.

7. A device in accordance with claim 6, wherein said moving structure includes a frame that is connected as a single piece with the said mobile equipment and sustains said positioning means, which rest on it so that when the said mobile equipment is in its lowered position relative to said container, said positioning means will become transferred to and rest on the said container, so that the moving structure will be disengaged from both said positioning means and said container.

8. A device in accordance with claim 7, wherein said positioning means and the associated moving structure are provided with complementary centering formations ensuring accurate positioning of said positioning means and the said moving structure relative to the said container.

9. A device in accordance with claim 8, wherein said complementary formations include at least one pin element engagable with a corresponding cavity.

10. A device in accordance with claim 8, wherein said complementary formations include a fork structure.

* * * * *